US005390971A

United States Patent [19]

Warren

[11] Patent Number: 5,390,971

[45] Date of Patent: Feb. 21, 1995

[54] HOLDER FOR A BAR OF SOAP

[76] Inventor: Tony Warren, 134 W. 58th St.; Apt. 304, New York, N.Y. 10019

[21] Appl. No.: 161,590

[22] Filed: Dec. 6, 1993

[51] Int. Cl.[6] ..... A47K 5/05

[52] U.S. Cl. ..... 294/25; 294/1.1; 401/8; 401/88

[58] Field of Search ..... 294/1.1, 5, 5.5, 15, 294/25, 61, 64.1, 99.1, 99.2; 16/114 R; 224/218; 248/684; 401/6–8, 19, 49, 88

[56] References Cited

U.S. PATENT DOCUMENTS

| | | | |
|---|---|---|---|
| 1,122,882 | 12/1914 | East | 401/8 |
| 1,265,409 | 5/1918 | Wirth | 401/88 |
| 1,333,941 | 3/1920 | Silver | 401/88 |
| 1,350,585 | 8/1920 | Wirth | 401/88 |
| 1,689,787 | 10/1928 | Kupferschmid | 401/88 |
| 2,283,988 | 5/1942 | Heath | 401/6 |
| 2,770,071 | 11/1956 | Endres et al. | 401/8 |
| 3,100,363 | 8/1963 | Staver | 401/6 |
| 3,286,686 | 11/1966 | Staver | 401/6 |
| 3,697,111 | 10/1972 | Thompson | 294/64.1 |
| 5,011,316 | 4/1991 | Damon | 294/64.1 X |

FOREIGN PATENT DOCUMENTS

| | | | |
|---|---|---|---|
| 632320 | 1/1927 | France | 401/8 |

*Primary Examiner*—Johnny D. Cherry
*Attorney, Agent, or Firm*—Michael I. Kroll

[57] ABSTRACT

A holder is provided for a bar of soap, which consists of a structure for affixing firmly into a surrounding mass on an outer surface of the bar of soap. A component is for holding a hand of a person. An element is for attaching the holding component to the affixing structure, so that the hand of the person can conveniently hold onto the bar of soap when it becomes wet and slippery.

8 Claims, 2 Drawing Sheets

HOLDER FOR A BAR OF SOAP

BACKGROUND OF THE INVENTION

1. Field of the Invention

The instant invention relates generally to soap bar constructions and more specifically it relates to a holder for a bar of soap.

2. Description of the Prior Art

A conventional bar of soap becomes slippery when wet and is frequently dropped onto the shower stall floor or let loose in the bath water. During a shower the slippery bar of soap is especially a nuisance since a person must bend over in the shower stall to retrieve it, thereby getting the hair wet when it may be inconvenient to do so. Having to bend over to retrieve the bar of soap is often more than inconvenient, especially to those who suffer from a bad back, who are arthritic or who may have a handicap that makes bending over difficult. In the shower, adults, as well as senior citizens, tend to lose their balance when bending over to pick up the bar of soap off the floor of the stall.

Numerous soap bar constructions have been provided in prior art. For example, U.S. patents numbered U.S. Pat. Nos. 4,741,852 to Ondracek; 4,746,452 to Marek; 4,965,008 to Chang and U.K. patent number 2,241,247 to Bone all are illustrative of such prior art. While these units may be suitable for the particular purpose to which they address, they would not be as suitable for the purposes of the present invention as heretofore described.

Ondracek, John

NON-SLIP SOAP BAR CONSTRUCTION

U.S. Pat. No. 4,741,852

A non-slip soap bar construction comprising a bar of soap having an upper half and a lower half. An elongated generally I-shaped fabric member is captured between the upper and lower halves of the bar of soap. The enlarged ends of the fabric member project beyond the sides of the bar of soap and form non-slip flap portions that provide positive gripping surfaces for the bar of soap.

Marek, William E.

EASY TO HOLD LUBRICOUS COMPOSITION ARTICLES

U.S. Pat. No. 4,746,452

Lubricous compositions such as cleansing soap are fabricated into a geometric shape which facilitates their being hand held while being used. In one embodiment, a bar of soap is provided having finger-gripping surfaces on both top and bottom as well as around the bar periphery.

Chang, Chun-Hsiung

BAR OF SOAP HAVING A RECESSED PORTION FOR RECEIVING ANOTHER, USED, PIECE OF SOAP

U.S. Pat. No. 4,965,008

A bar of soap has a recessed portion for receiving another used piece of soap which is to be adhered thereto. The bar of soap has a marked portion formed therein which only becomes exposed when the bar of soap has been worn to a predetermined size adapted to be inserted in the recessed portion of another unused bar of soap having a recessed portion as described above.

Bone, Paul Anthony

FLOATING SOAP

U.K. Patent Number 2,241,247

A bar of soap which could be of irregular novelty shape, or of a regular shape. Inside the bar of soap is encased a capsule which is hollow and made of plastic and will allow the soap to float. The capsule has many indentations to stop the soap from detaching from the capsule. The capsule is manufactured in two halves, and joined together to provide an air tight seal.

SUMMARY OF THE INVENTION

A primary object of the present invention is to provide a holder for a bar of soap that will overcome the shortcomings of the prior art devices.

Another object is to provide a holder for a bar of soap that will allow a user to conveniently hold onto the bar of soap when it becomes wet and slippery.

An additional object is to provide a holder for a bar of soap that will help to eliminate the wasteful practice of dropping the bar of soap into bath water, where it remains to become sticky and then dissolve into the bath water.

A further object is to provide a holder for a bar of soap that is simple and easy to use.

A still further object is to provide a holder for a bar of soap that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
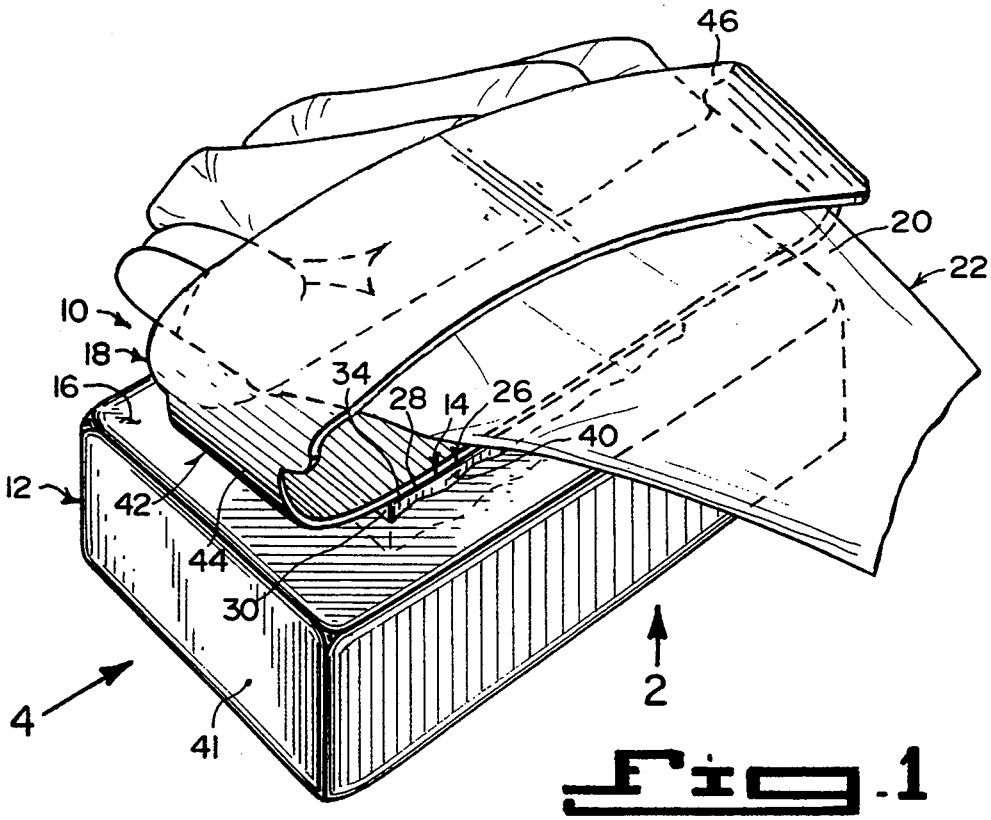
FIG. 1 is a top perspective view of the instant invention in use embedded into a rectangular shaped bar of soap.
Figure 2:
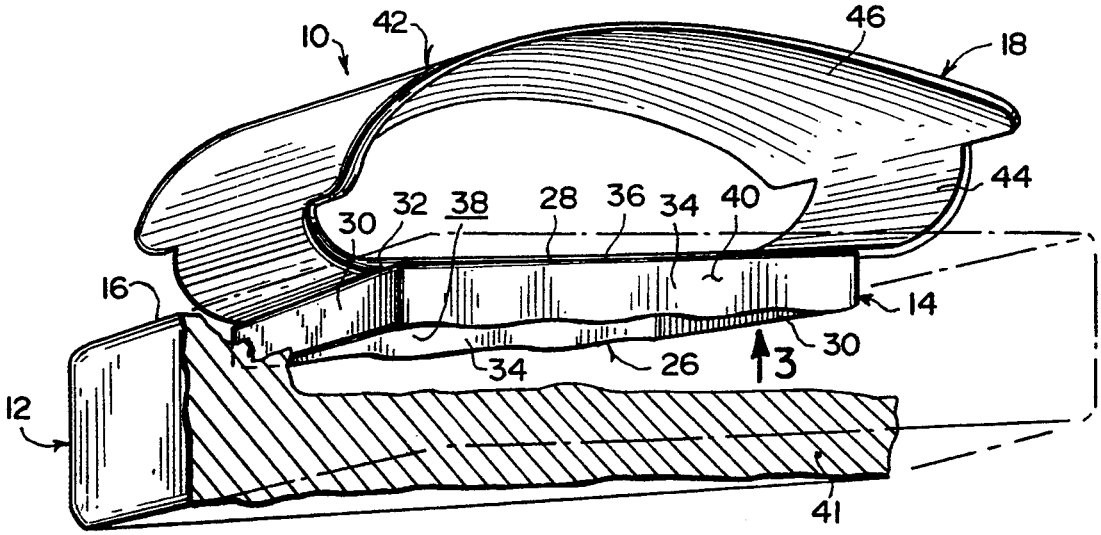
FIG. 2 is a bottom perspective view with parts broken away taken in the direction of arrow 2 in FIG. 1.
Figure 3:
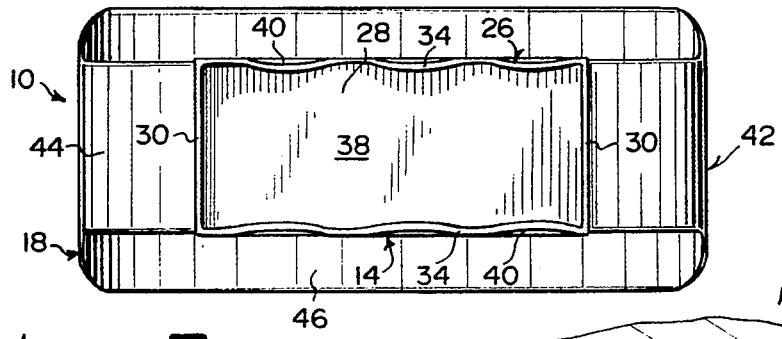
FIG. 3 is a bottom view of the instant invention per se taken in the direction of arrow 3 in FIG. 2.
Figure 4:
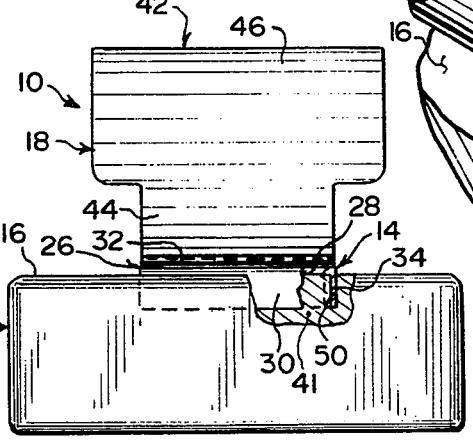
FIG. 4 is an end view with parts broken away and in section taken in the direction of arrow 4 in FIG. 1.
Figure 5:
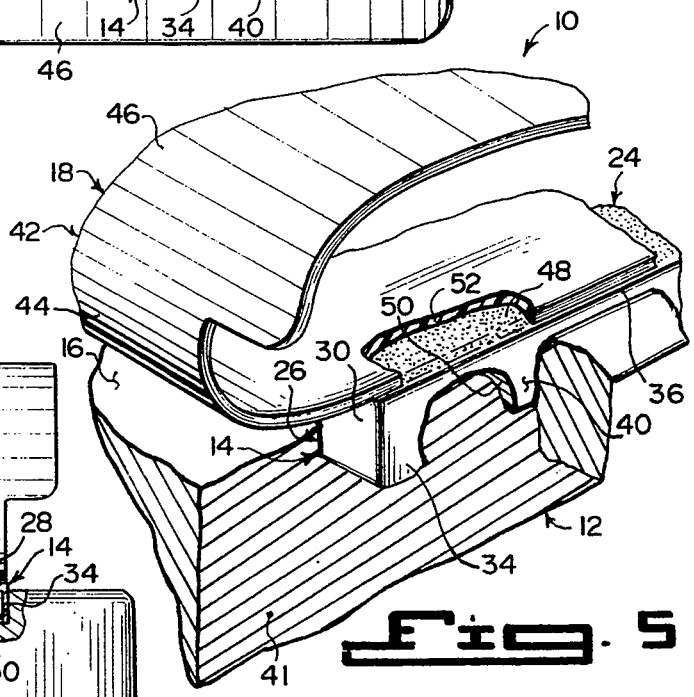
FIG. 5 is an enlarged top perspective view with parts broken away and in section showing the various components in greater detail.

Turning now descriptively to the drawings, in which similar reference characters denote similar elements throughout the several views, FIGS. 1 through 6 illustrate a holder 10 for a bar of soap 12 which consists of a structure 14 for affixing firmly to a surrounding mass on an outer surface 16 of the bar of soap 12. A component 18 is for holding a hand 20 of a person 22. An element 24, best seen in FIG. 5, is for attaching the holding component 18 to the affixing structure 14, so that the hand 20 of the person 22 can conveniently retain the bar of soap 12 when it becomes wet and slippery.

The affixing structure 14 is an embedding receptacle 26 to be inserted into the outer surface 16 of the bar of soap 12. The embedding receptacle 26 includes a rectangular top plate 28. A pair of end walls 30 are provided, with each extending downwardly from an opposite short edge 32 of the top plate 28. A pair of side walls 34 are also provided, with each extending downwardly from an opposite long edge 36 of the top plate 28, so as to form a chamber 38 to receive a portion of the bar of soap 12 at the outer surface 16. Each side wall 34 includes an undulating surface 40, so as to better engage with the soft material 41 of the bar of soap 12, when inserted into the outer surface 16 of the bar of soap 12.

The holding component 18 is a handle assembly 42, to be engaged by the hand 20 of the person 22. The handle assembly 42 includes a flexible loop strap 44 having a larger upper portion 46, in which the hand 20 of the person 22 can be inserted into, so as to hold onto the bar of soap 12 to prevent the bar of soap from falling from the hand 20. The attaching element 24 is a layer of adhesive material 48 applied between an upper surface of the top plate 28 of the embedding receptacle 26 and a lower surface of the flexible loop strap 44.

The embedding receptacle 26 may be fabricated out of an aluminum metal material 50. The flexible loop strap 44 may be fabricated out of a smooth plastic material 52. The flexible loop strap 44 is of a size, so that the hand 20 of the person 22 can be inserted comfortably into the flexible loop strap 44, to better securely hold onto the bar of soap 12 when it becomes wet and slippery.

Figure 6:
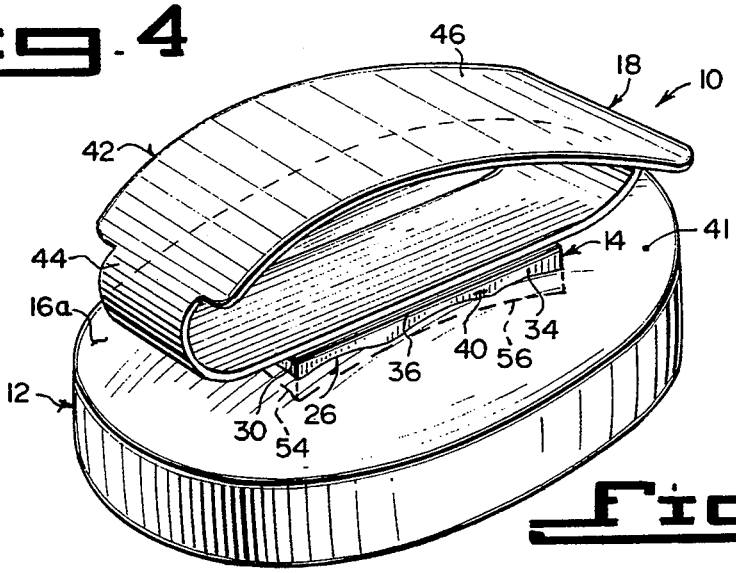
FIG. 6 is a top perspective view similar to FIG. 1 showing the instant invention, adapted to be embedded into an oval shaped bar of soap having curved top and bottom surfaces.

As shown in FIG. 6, each end wall 30 has a curved bottom edge 54. Each side wall 34 also has a curved bottom edge 56, so as to better engage with the soft material 41 of the bar of soap 12, when inserted into a curved outer surface **16*a* of the bar of soap 12**.

The holder 10 is ideal for use by children helping to eliminate the wasteful practice of dropping the bar of soap in the bath water where it remains, so as to become sticky. The holder 10 provides a solution to this problem in an efficient and practical manner.

The material of choice for the handle assembly 42 of the holder 10 is a smooth plastic material 52. It should be noted, however, that the basic form and function of this invention may be varied or modified, so that the application and use of the holder 10 could be broader than originally envisioned.

The holder 10 could be used for bath soap for babies where it would provide a secure hold for the parent, while holding the baby with one hand and soaping the baby with the other. As the bar of soap 12 gets wet and slippery, it is difficult to retrieve it in the baby's bath water.

Pastel colors for the handle assembly 42 of the holder 10 could match the color of the bar of soap 12 or be fabricated in a deeper hue. The entire product could be made of plastic, eliminating the need for aluminum and allowing the article to be molded in one operation.

Overall, the basic concept behind the holder 10 appears to be sound and the product idea workable. The basic materials are readily obtainable and the concept of a holder 10 to be attached to a bar of soap 12 to facilitate handling will have wide appeal.

LIST OF REFERENCE NUMBERS

10 holder
12 bar of soap
14 affixing structure
16 outer surface of 12
**16*a* curved outer surface of 12**
18 holding component
20 hand
22 person
24 attaching element
26 embedding receptacle for 14
28 rectangular top plate
30 end wall
32 short edge of 28
34 side wall
36 long edge of 28
38 chamber of 26
40 undulating surface of 34
41 soft material of 12
42 handle assembly for 18
44 flexible loop strap
46 larger upper portion of 44
48 adhesive material for 24
50 aluminum metal material of 26
52 smooth plastic material of 44
54 curved bottom edge of 30
56 curved bottom edge of 34

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A holder for a bar of soap which comprises:

a) means for affixing firmly into a surrounding mass on an outer surface of the bar of soap, said affixing means is an embedding receptacle to be inserted into the outer surface of the bar of soap, said embedding receptacle including a rectangular top plate, a pair of end walls, each extending downwardly from an opposite short edge of said top plate, and a pair of side walls, each extending downwardly from an opposite long edge of said top plate, so as to form a chamber to receive a portion of the bar of soap at the outer surface, each said side wall includes an undulating surface, so as to better engage with the soft material of the bar of soap when inserted into the outer surface of the bar of soap;

b) means for holding by a hand of a person; and c) means for attaching said holding means to said affixing means, so that the hand of the person can conveniently retain the bar of soap when it becomes wet and slippery.

2. A holder as recited in claim 1, wherein said holding means is a handle assembly to be engaged by the hand of the person.

3. A holder as recited in claim 2, wherein said handle assembly includes a flexible loop strap having a larger upper portion in which the hand of the person can be inserted into, so as to hold onto the bar of soap to prevent the bar of soap from falling from the hand.

4. A holder as recited in claim 3, wherein said attaching means is a layer of adhesive material applied between an upper surface of said top plate of said embedding receptacle and a lower surface of said flexible loop strap.

5. A holder as recited in claim 4, wherein said embedding receptacle is fabricated out of an aluminum metal material.

6. A holder as recited in claim 5, wherein said flexible loop strap is fabricated out of a smooth plastic material.

7. A holder as recited in claim 6, wherein said flexible loop is of a size, so that the hand of the person can be inserted comfortably into said flexible loop strap to better securely hold onto the bar of soap when it becomes wet and slippery.

8. A holder as recited in claim 7, further including:

a) each said end wall having a curved bottom edge; and b) each said side wall having a curved bottom edge, so as to better engage with the soft material of the bar of soap, when inserted into a curved outer surface of the bar of soap.

* * * * *